US006462712B1

(12) United States Patent
Liang

(10) Patent No.: US 6,462,712 B1
(45) Date of Patent: Oct. 8, 2002

(54) FREQUENCY TUNABLE PATCH ANTENNA DEVICE

(76) Inventor: Ming Cheng Liang, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 09/910,895

(22) Filed: Jul. 24, 2001

(51) Int. Cl.[7] ..... H01Q 1/38; H01Q 9/00
(52) U.S. Cl. ..... 343/700 MS; 343/749
(58) Field of Search ..... 343/700 MS, 745, 343/749, 750, 829, 846

(56) References Cited

U.S. PATENT DOCUMENTS 5,021,795 A * 6/1991 Masiulis ..... 343/700 MS
5,767,810 A * 6/1998 Hagiwara et al. .... 343/700 MS
5,917,450 A * 6/1999 Tsunekawa et al. .. 343/700 MS
6,061,025 A * 5/2000 Jackson et al. ..... 343/700 MS
6,154,176 A * 11/2000 Fathy et al. ..... 343/700 MS
6,326,919 B1 * 12/2001 Diximus et al. ..... 343/700 MS

* cited by examiner

*Primary Examiner*—Don Wong
*Assistant Examiner*—Hoang Nguyen

(57) ABSTRACT

A patch antenna device includes an antenna patch, and one or more capacitors loaded into the antenna patch for increasing an equivalent working area to the antenna patch. The capacitor may be any suitable capacitor, such as the chip capacitor. The provision of the capacitor into the antenna patch allows the electricity to flow into and to flow out of the capacitor, and consumes less electric power. A ground board and a dielectric plate are attached to the antenna patch. One or more feeds and probes are loaded into the antenna patch for exciting various modes.

2 Claims, 7 Drawing Sheets

FREQUENCY TUNABLE PATCH ANTENNA DEVICE

BACKGROUND OF THE INVENTION

1. Field of the Invention

The present invention relates to a microstrip patch antenna device, and more particularly to a frequency tunable microstrip patch antenna device.

2. Description of the Prior Art

The typical microstrip patch antenna devices, as shown in FIGS. 1–8, are provided for attaching onto the objects, particularly the electric facilities, such as the mobile phones, portable phones, etc., and comprise a dielectric intermediate plate 2 disposed between a lower ground board 1 and an upper antenna patch 3, and two feeds 4, 5 disposed in the antenna patch 3 for exciting the antenna patch 3. The operating frequencies of the patch antenna devices are related to or are determined by the areas and/or the shapes and/or the locations of the antenna patches 3. Accordingly, the areas and/or the shapes and/or the locations of the antenna patches 3 are changed or adjusted in order to obtain or to operate the patch antenna devices at different or various frequencies. FIGS. 1–8 illustrate the typical microstrip patch antenna devices that may only change or adjust the antenna patches 3 to different shapes or areas or locations, in order to obtain or to operate the patch antenna devices at different or various frequencies.

However, due to the limit size of the objects, such as the mobile phones, portable phones, etc., the areas of the antenna patches 3 are limited and may not be increased to a area over the allowed attaching or mounting area in the objects. Accordingly, the working frequencies, particularly the obtainable working frequencies of the patch antenna devices are limited. When the areas of the antenna patches are reduced, the signals may not be suitable received, and additional amplifier devices are further required to amplify the receiving signals. In addition, the typical patch antenna devices consume much electricities.

The present invention has arisen to mitigate and/or obviate the afore-described disadvantages of the conventional microstrip patch antennas.

SUMMARY OF THE INVENTION

The primary objective of the present invention is to provide a frequency tunable microstrip patch antenna device including one or more capacitors engaged in the antenna patch for increasing or enlarging the effective working area and for increasing the resonant modes of the patch antenna device, or for increasing the effective bandwidth for the patch antenna device.

The other objective of the present invention is to provide a frequency tunable microstrip patch antenna device including one or more fees that may be changed to different positions or locations in the antenna patch for simultaneously exciting different or various kinds of operating modes for the patch antenna device.

The further objective of the present invention is to provide a frequency tunable microstrip patch antenna device that may consume less electric power.

In accordance with one aspect of the invention, there is provided a patch antenna device comprising an antenna patch, and at least one capacitor loaded into the antenna patch for generating and increasing an equivalent working area to the antenna patch. The capacitor may be any kind of suitable capacitor, such as the chip capacitor. The provision of the capacitor into the antenna patch allows the electricity to flow into and to flow out of the capacitor, and consumes less electric power.

A ground board is further. provided, and a dielectric plate is further provided and disposed between the antenna patch and the ground board.

One or more feeds are further provided and loaded into the antenna patch for exciting various kinds of resonate modes or radiation modes at the same time. The feeds may be changed to different positions or locations relative to the antenna patch, for exciting different resonate modes or radiation modes at the same time.

The feeds each includes a probe extended through the dielectric plate and extended toward the ground board. A protective shield is preferably disposed between the probe and the ground board for protecting the probe and for preventing the probe from being grounded by the ground board.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
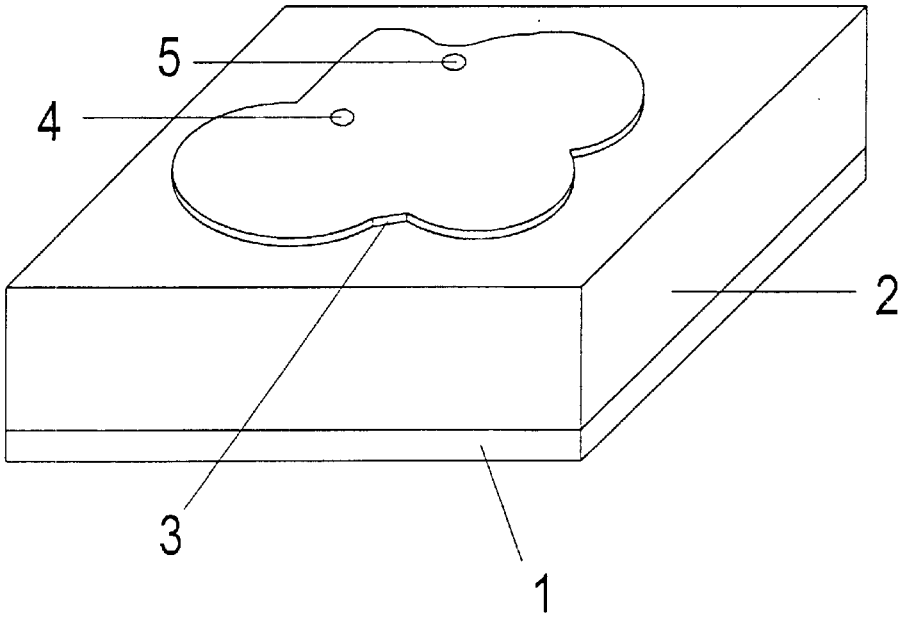
FIG. 1 PRIOR ART
FIGS. 1, 2, 3, 4, 5, 6, 7, 8 are perspective views illustrating the typical microstrip patch antenna devices.
Figure 2:
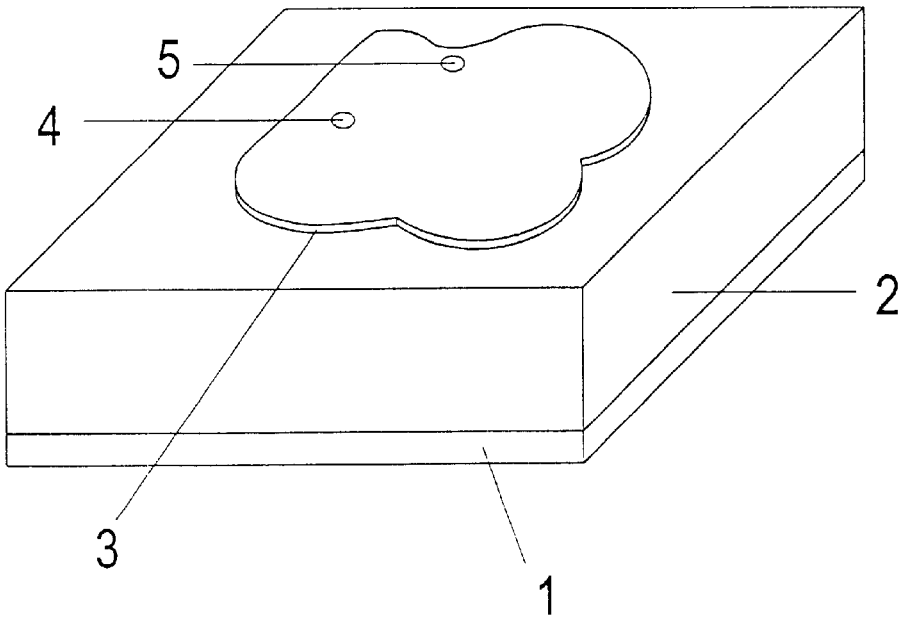
FIG. 2 PRIOR ART
Figure 3:
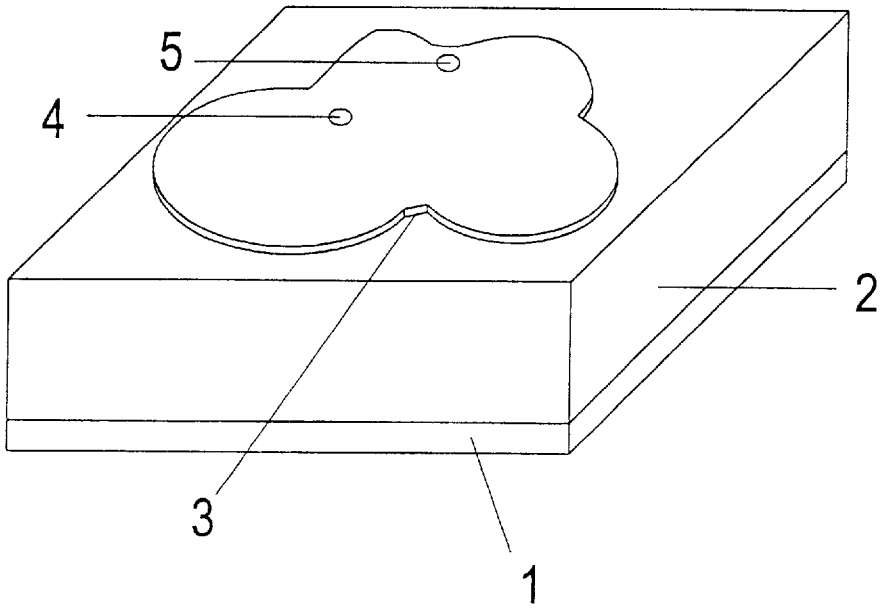
FIG. 3 PRIOR ART
Figure 4:
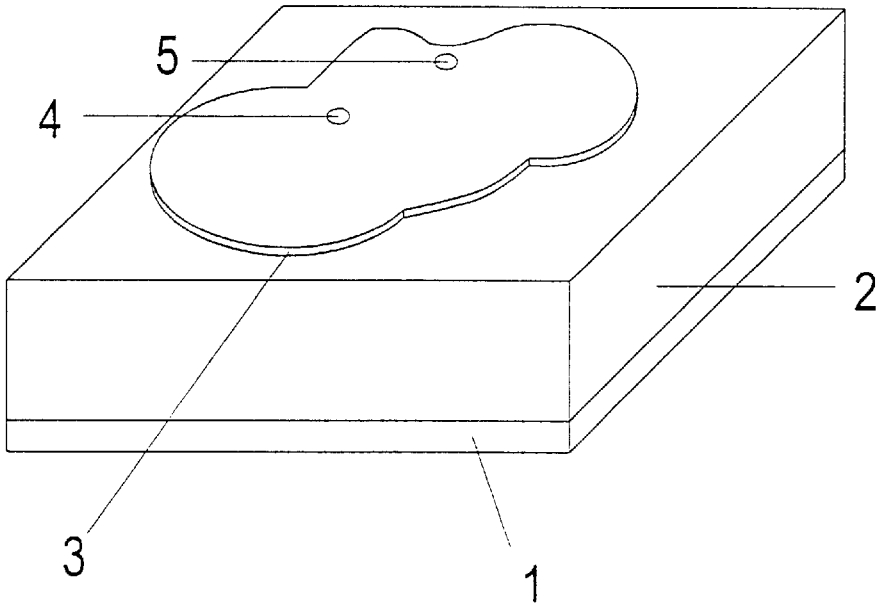
FIG. 4 PRIOR ART
Figure 5:
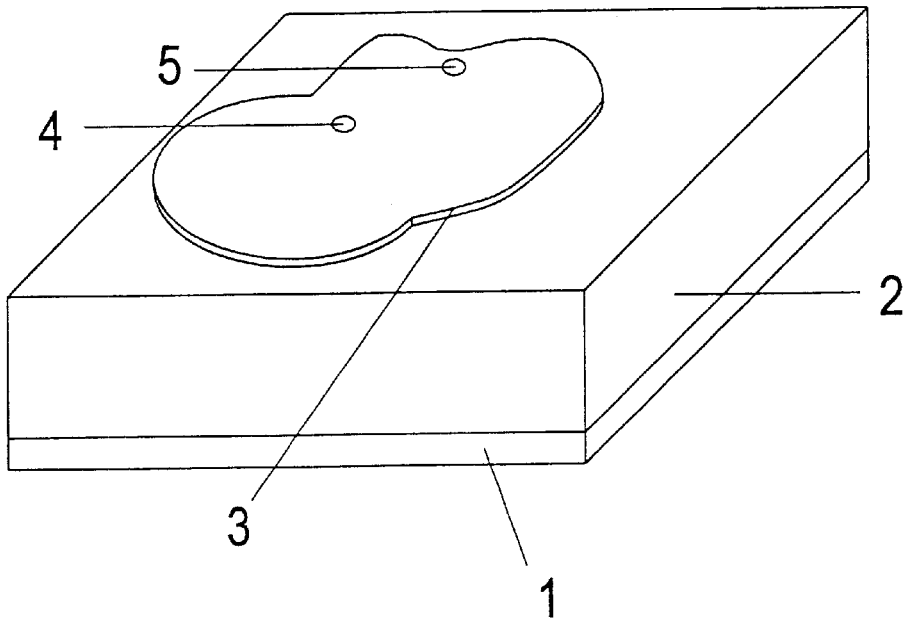
FIG. 5 PRIOR ART
Figure 6:
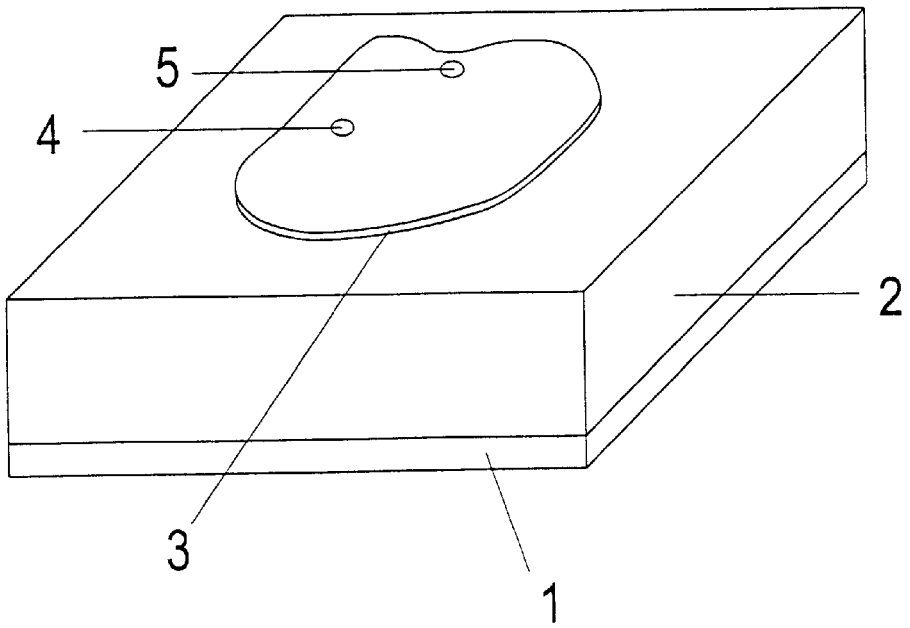
FIG. 6 PRIOR ART
Figure 7:
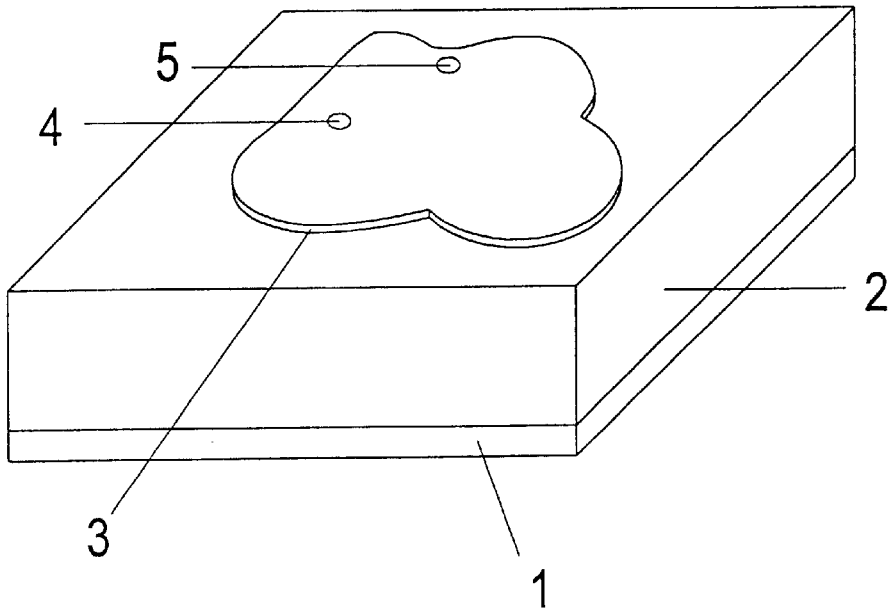
FIG. 7 PRIOR ART
Figure 8:
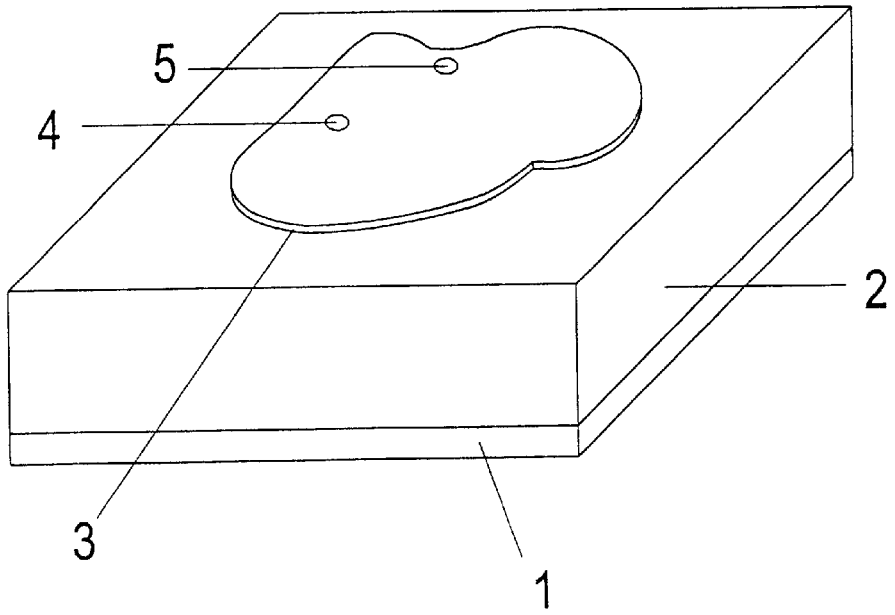
FIG. 8 PRIOR ART
Figure 9:
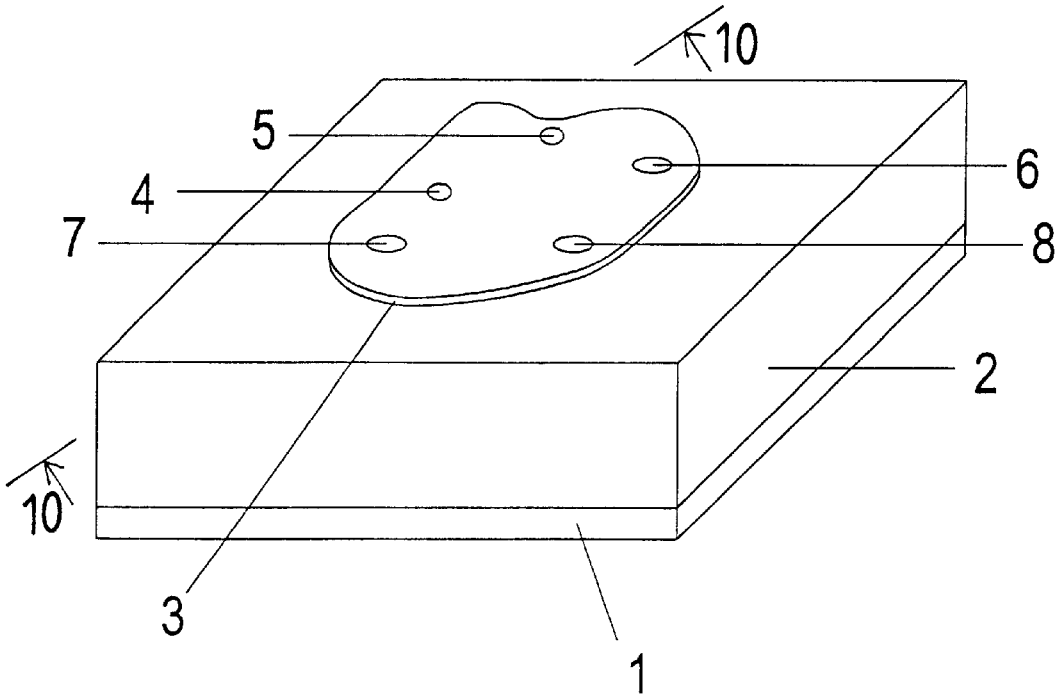
FIG. 9 is a perspective view of a frequency tunable microstrip patch antenna device in accordance with the present invention.

Referring to the drawings, and initially to FIGS. 9–12, a frequency tunable microstrip patch antenna device in accordance with the present invention comprises a dielectric intermediate plate 2 disposed between a lower ground board 1 and an upper antenna patch 3, and one or more feeds 4, 5 disposed in the antenna patch 3 for exciting the antenna patch 3. The feeds 4, 5 each preferably includes a probe 9 extended through the dielectric intermediate plate 2 and extended toward or between the lower ground board 1 and the upper antenna patch 3, and each includes a protective sleeve or shield 90 engaged between the probes 9 and the ground board 1, for preventing the probes 9 from being grounded and for allowing the signals to be sent to the antenna patch 3 via the probes 9 and the feeds 4, 5.

Figure 10:
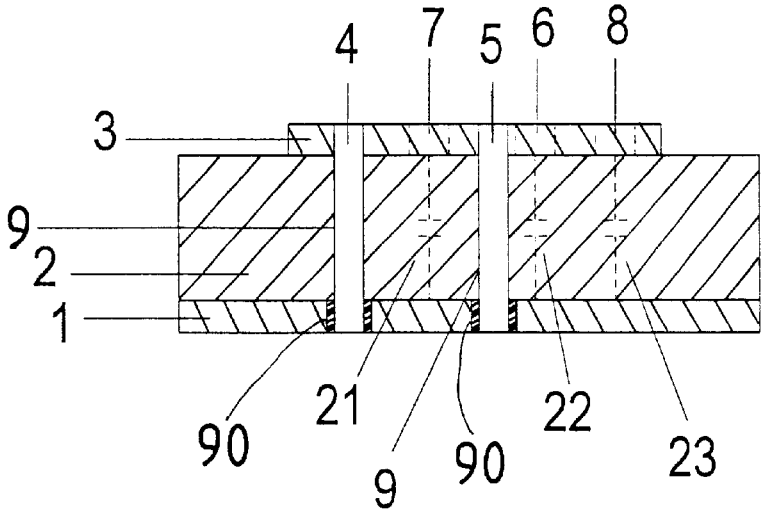
FIG. 10 is a cross sectional view taken along lines 10—10 of FIG. 9.
Figure 11:
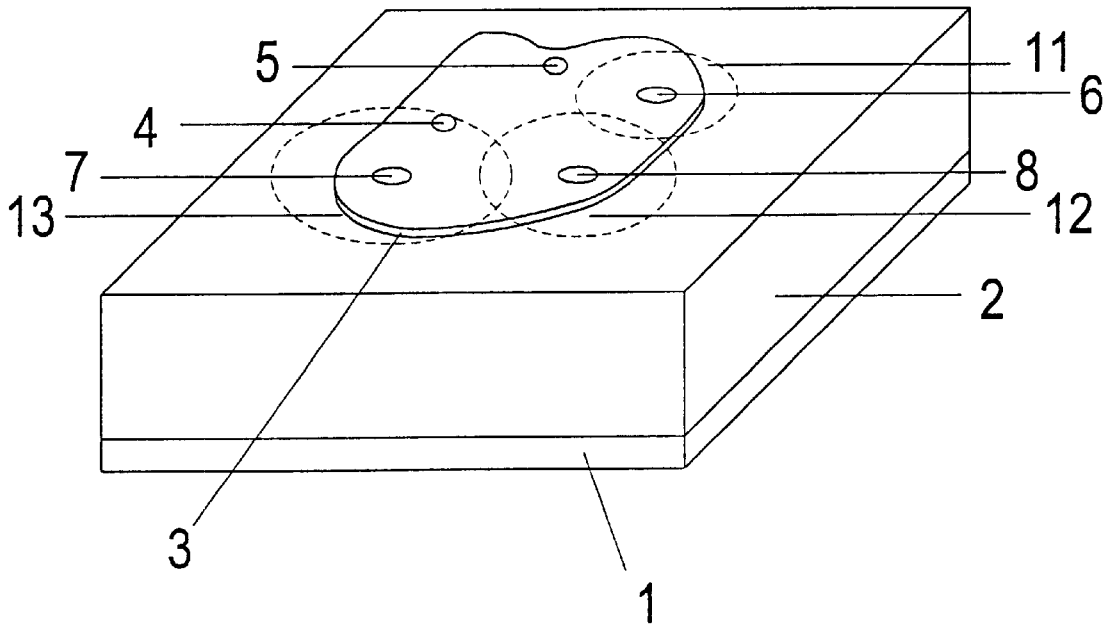
FIG. 11 is a perspective view similar to FIG. 9, illustrating the operation of the frequency tunable microstrip patch antenna device in accordance with the present invention.
Figure 12:
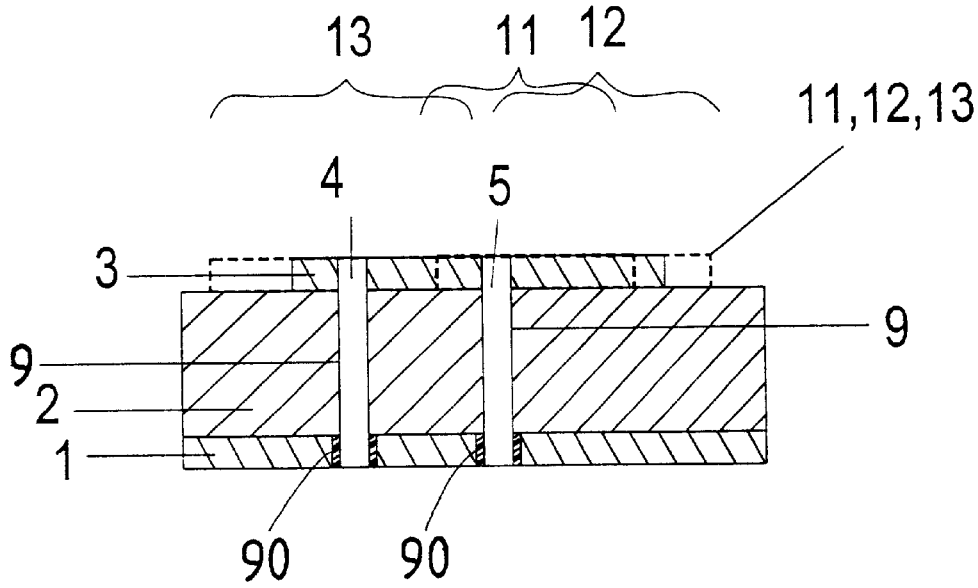
FIG. 12 is a cross sectional view similar to FIG. 10, illustrating the operation of the frequency tunable microstrip patch antenna device.

The frequency tunable microstrip patch antenna device in accordance with the present invention further comprises one or more capacitors 6, 7, 8 engaged in or introduced into or loaded into the antenna patch 3. The capacitors 6, 7, 8 may be disposed or loaded into different positions relative to the antenna patch 3, for forming or generating an effective or equivalent antenna patch working area 11, 12, 13 around the respective capacitors 6, 7, 8; i.e., the introducing or the loading of the capacitors 6, 7, 8 into the antenna patch 3 may increase or enlarge the effective working area or may increase or enlarge the equivalent area of the antenna patch 3 by the effective or equivalent antenna patch working area 11, 12, 13 generated by and around the respective capacitors 6, 7, 8, as shown in dotted lines in FIGS. 11, 12. As shown in FIG. 10, the equivalent capacitor 21, 22, 23 may be formed between the ground board 1 and the respective capacitors 6, 7, 8, and may be parallel to each other for greatly increasing the capacitance of the patch antenna device.

It is to be noted that the operating frequencies of the patch antenna devices are or may be determined by the areas and/or the shapes of the antenna patch 3. One of the reasons is that the antenna patch 3 is a resonator, or the patch antenna device is a resonator. The introducing or the loading of the capacitors 6, 7, 8 into the antenna patch 3, and/or the different positions or locations of the capacitors 6, 7, 8 relative to the antenna patch 3 may thus be used for increasing or enlarging or decreasing the effective working frequencies of the antenna patch 3, and thus for increasing or decreasing the resonant modes and/or the effective bandwidth for the patch antenna device.

It is further to be noted that the capacitors 6, 7, 8 may-be various kinds of capacitors, such as the chip capacitors or the like. The capacitors 6, 7, 8 having different capacitances may also be used to change the effective working areas or the equivalent areas of the antenna patch 3, and may thus be used for changing the effective working frequencies of the antenna patch 3. The provision of the capacitors 6, 7, 8 allows the electricity to flow into and out of the capacitors 6, 7, 8. The introducing of the capacitors 6, 7, 8 into the antenna patch 3 will not consume much electric power.

The change of the positions or the locations of the feeds 4, 5 relative to the antenna patch 3 may be used to excite different resonate modes or radiation modes, and may be used to excite many resonate modes or radiation modes simultaneously.

Figure 13:
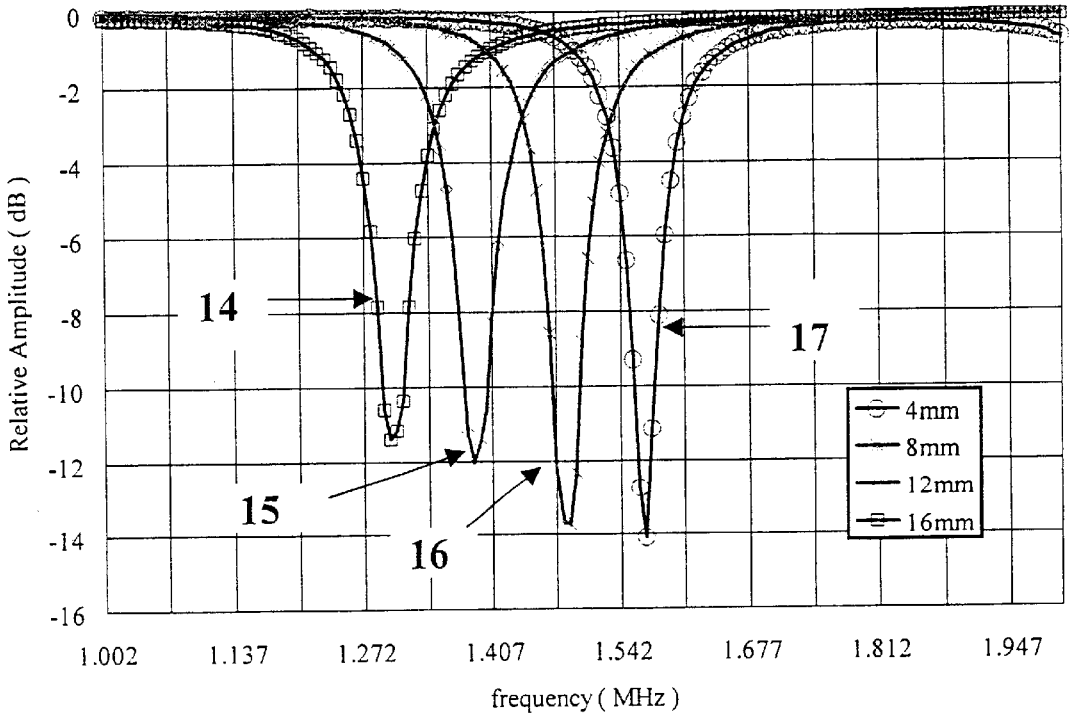
FIGS. 13, 14 are charts illustrating the operation of the frequency tunable microstrip patch antenna device.
Figure 14:
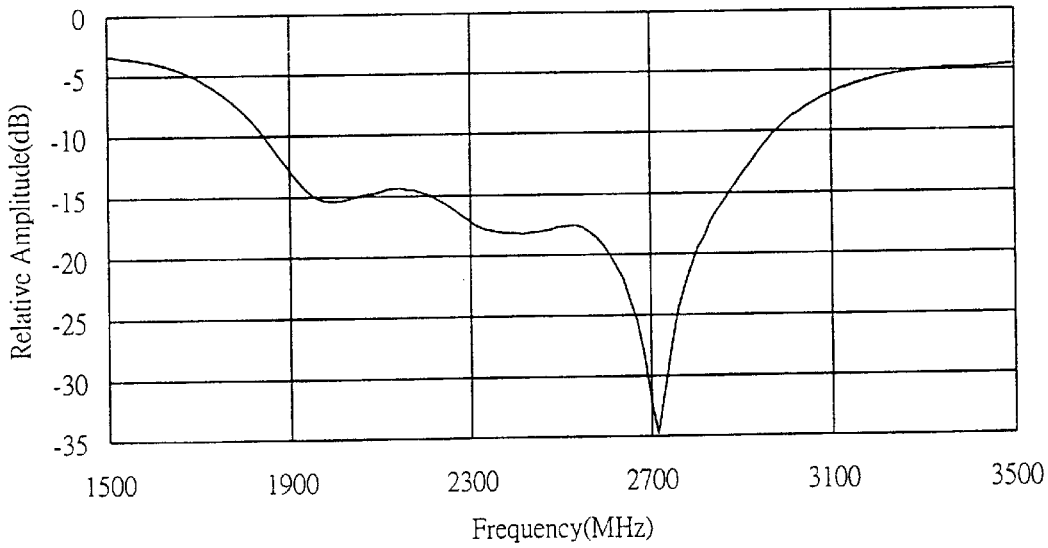

Referring next to FIG. 13, the curves marked with the reference numerals 14, 15, 16, 17 are. the resonate modes or the radiation modes of different frequencies for the patch antenna device excited due to different effective working areas of the antenna patch 3. FIG. 14 shows the residue from the resonate modes or the radiation modes of different frequencies that shown in the curves 14, 15, 16, 17. When different or various radiation modes or resonate modes are excited at the same time, the usable bandwidth of the patch antenna device may be significantly increased.

Accordingly, the frequency tunable microstrip patch antenna device in accordance with the present invention includes one or more capacitors engaged in the antenna patch for increasing or enlarging the effective working area and for increasing the resonant modes of the patch antenna device, or for increasing the effective bandwidth for the patch antenna device, and includes one or more fees that may be changed to different positions or locations in the antenna patch for simultaneously exciting different or various kinds of operating modes for the patch antenna device. The frequency tunable microstrip patch antenna device may consume less electric power.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A patch antenna device comprising:

an antenna patch, a ground board, a dielectric plate disposed between said antenna patch and said ground board, at least one feed electrically coupled to said antenna patch, and including a probe extended through said dielectric plate and extended toward said ground board, and at least one capacitor engaged into said antenna patch for generating and increasing an equivalent working area to said antenna patch.

2. The patch antenna device according to claim 1 further comprising a protective shield disposed between said probe and said ground board for preventing said probe from being grounded by said ground board.

* * * * *